US007749019B2

(12) United States Patent
Valentin et al.

(10) Patent No.: US 7,749,019 B2
(45) Date of Patent: Jul. 6, 2010

(54) HOSPITAL GRADE ELECTRICAL RECEPTACLE

(75) Inventors: William R. Valentin, Meriden, CT (US); Michael J. Marchetti, Bridgeport, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 12/320,116

(22) Filed: Jan. 16, 2009

(65) Prior Publication Data

US 2009/0149062 A1 Jun. 11, 2009

Related U.S. Application Data

(63) Continuation-in-part of application No. 11/797,085, filed on Apr. 30, 2007, now Pat. No. 7,479,031.

(51) Int. Cl.
*H01R 13/66* (2006.01)

(52) U.S. Cl. ..... 439/538; 439/107; 439/650

(58) Field of Classification Search ..... 439/535, 439/536, 538, 539, 650, 107; 174/53–55, 174/58, 66

See application file for complete search history.

(56) References Cited

U.S. PATENT DOCUMENTS

| | | | | |
|---|---|---|---|---|
| 2,315,523 | A | 4/1943 | Hubbell | |
| 3,064,071 | A * | 11/1962 | O'Donnell | 174/53 |
| 3,688,239 | A * | 8/1972 | Jaconette | 439/97 |
| 3,868,161 | A | 2/1975 | Frantz | |
| 4,025,144 | A * | 5/1977 | Thibeault | 439/539 |
| 4,059,328 | A | 11/1977 | Rigo | |
| 4,379,605 | A | 4/1983 | Hoffman | |
| 4,552,421 | A | 11/1985 | Drapkin | |
| 4,872,081 | A | 10/1989 | Murphy et al. | |
| 4,872,087 | A | 10/1989 | Brant | |
| 5,572,406 | A | 11/1996 | Strang et al. | |
| 5,637,000 | A | 6/1997 | Osterbrock et al. | |
| 6,015,303 | A | 1/2000 | Bonilla et al. | |
| 6,109,937 | A | 8/2000 | Bonilla et al. | |
| 6,199,264 | B1 | 3/2001 | Marcou et al. | |
| 6,293,812 | B1 | 9/2001 | Ewer et al. | |
| 6,398,594 | B1 | 6/2002 | Bonilla et al. | |
| 6,767,245 | B2 | 7/2004 | King | |
| 6,827,602 | B2 | 12/2004 | Greene et al. | |
| 6,939,149 | B2 | 9/2005 | Goodsell et al. | |
| 7,031,126 | B2 | 4/2006 | Bonilla et al. | |
| 7,164,082 | B2 | 1/2007 | Kurek et al. | |
| 2008/0190640 | A1 * | 8/2008 | Gorman | 174/53 |

* cited by examiner

*Primary Examiner*—Tho D Ta
(74) *Attorney, Agent, or Firm*—Jenae C. Gureff; Mark S. Bicks; Alfred N. Goodman

(57) ABSTRACT

An electrical receptacle includes a housing having a cover or face member coupled to a base, and a mounting bridge extending around and contacting the bottom and the two opposite ends of the base. Each of the end-contacting portions of the mounting bridge has at least one base tab that projects inwardly into engagement with the end of the base, and at least one face tab, preferably barbed, that projects upwardly into the face member. During assembly, the base tabs preferably are bent over an upper edge of the base to firmly clamp the mounting bridge to the base. A line contact assembly extending along each side of the base has at least one line contact tab that projects upwardly into the face member. Mating snap-fit connectors afford additional robustness to the assembly.

30 Claims, 7 Drawing Sheets

HOSPITAL GRADE ELECTRICAL RECEPTACLE

CROSS-REFERENCE TO RELATED APPLICATIONS

This application is a continuation-in-part of U.S. patent application Ser. No. 11/797,085, filed Apr. 30, 2007 (to issue as U.S. Pat. No. 7,479,031 on Jan. 20, 2009), the subject matter of which application is incorporated herein by reference in its entirety.

FIELD OF THE INVENTION

The present invention relates to electrical receptacles, such as 15 and 20 amp duplex receptacles. More particularly, the present invention relates to a robust receptacle having a face member, a base, a mounting bridge and connection features that securely bind these and other components of the receptacle together.

BACKGROUND OF THE INVENTION

Conventional electrical receptacles have two-piece housings formed of separate mating front and back covers held together by fastening elements. A mounting bridge with ears at opposite ends is attached to the housing and allows the housing to be attached to a suitable structure, such as a building wall or an electrical box. In some electrical receptacle designs, the mounting bridge has a generally U-shape so as to wrap around portions of the mated front and back covers of the housing and couple to the front and back covers. In other electrical receptacle designs, the mounting bridge is a relatively flat shape and is sandwiched between the mated front and back covers of the housing.

The mounting bridge can be coupled to the housing separate mechanical fasteners, such as screws or rivets. The use of such fasteners results in a rigidly secured, hard to separate housing, but one which is difficult to assemble. In many situations, it is necessary to assemble multiple housings, each having multiple fasteners, creating a time consuming and tedious job.

Other conventional receptacle housings have a snap-fit design, wherein the front cover snaps to the back cover, sandwiching the mounting bridge between them. Several designs of snap-fit housings for electrical receptacles are disclosed in U.S. Pat. No. 4,872,087 to Brant, U.S. Pat. No. 5,510,760 to Marcou et al and U.S. Pat. No. 6,015,303 to Bonilla et al., which are herein incorporated by reference. A design of a snap-fit housing for an accessory strip to an outlet cover plate is disclosed in U.S. Pat. No. 5,613,874 to Orlando et al., which is herein incorporated by reference. While these prior art snap-fit designs allow quick assembly of the housing without the use of screws or rivets, they may not afford the degree of assembly integrity, strength and durability required for more demanding applications, such as heavy commercial use or UL hospital grade specifications.

Consequently, a need exists for a more robust housing and mounting bridge assembly for an electrical receptacle that is quick and easy to assemble.

SUMMARY OF THE INVENTION

The invention satisfies the aforementioned need by providing an electrical receptacle comprising a housing having a cover or face member coupled to a base, and a mounting bridge extending around and contacting the bottom and the two opposite ends of the base. Each of the end-contacting portions of the mounting bridge has at least one base tab that projects inwardly into engagement with the end of the base, and at least one face tab that projects upwardly into the face member.

Preferably there are two base tabs and two face tabs at each end of the mounting bridge, with the base tabs located at respective sides of the mounting member and the face tabs located inboard and adjacent the base tabs. The face tabs preferably are barbed and are tightly received in respective pockets in the face member. The base tabs preferably are received in respective recesses in the ends of the base. Each of these recesses preferably is in the form of a notch at the upper edge of the base into which the base tab is bent during assembly to firmly clamp the mounting bridge to the base.

The face tabs preferably are wider than the base tabs. For added robustness, the ends of the base and the end-contacting portions of the mounting bridge may have mating snap-fit connectors; and the face member and the base may also have mating snap-fit connectors.

In addition to some or all of the features mentioned above, the electrical receptacle of the invention preferably includes a pair of line contact assemblies that engage and extend along opposite sides of the base, each of the line contact assemblies having at least one line contact tab that projects upwardly into the face member. Each of the line contact assemblies preferably has a pair of line contact tabs, and each of those tabs preferably is tightly received in a respective pocket in the face member.

As used in this application, the terms "top," "bottom," "side" and "end" are intended to facilitate the description of the receptacle regardless of its orientation, and are not intended to limit the structure or use of the receptacle to any particular orientation.

Other advantages and salient features of the present invention will become apparent from the following detailed description, which, taken in conjunction with the annexed drawings, discloses a preferred embodiment of the invention.

BRIEF DESCRIPTION OF THE DRAWINGS

Referring to the drawings which form a part of this disclosure.

DETAILED DESCRIPTION OF THE INVENTION

Figure 1:
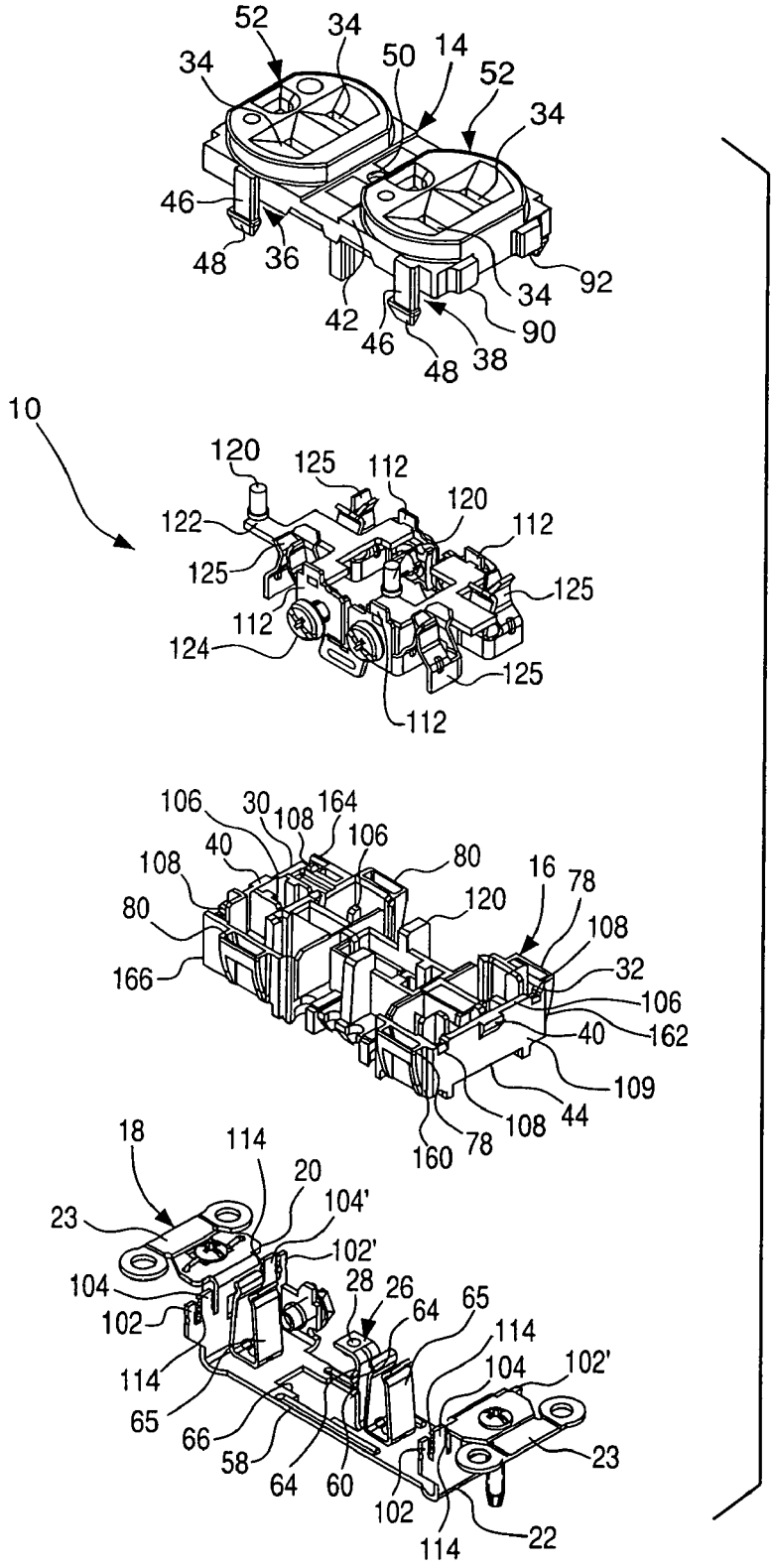
FIG. 1 is an exploded side perspective view of one embodiment of a receptacle according to the present invention.
Figure 2:
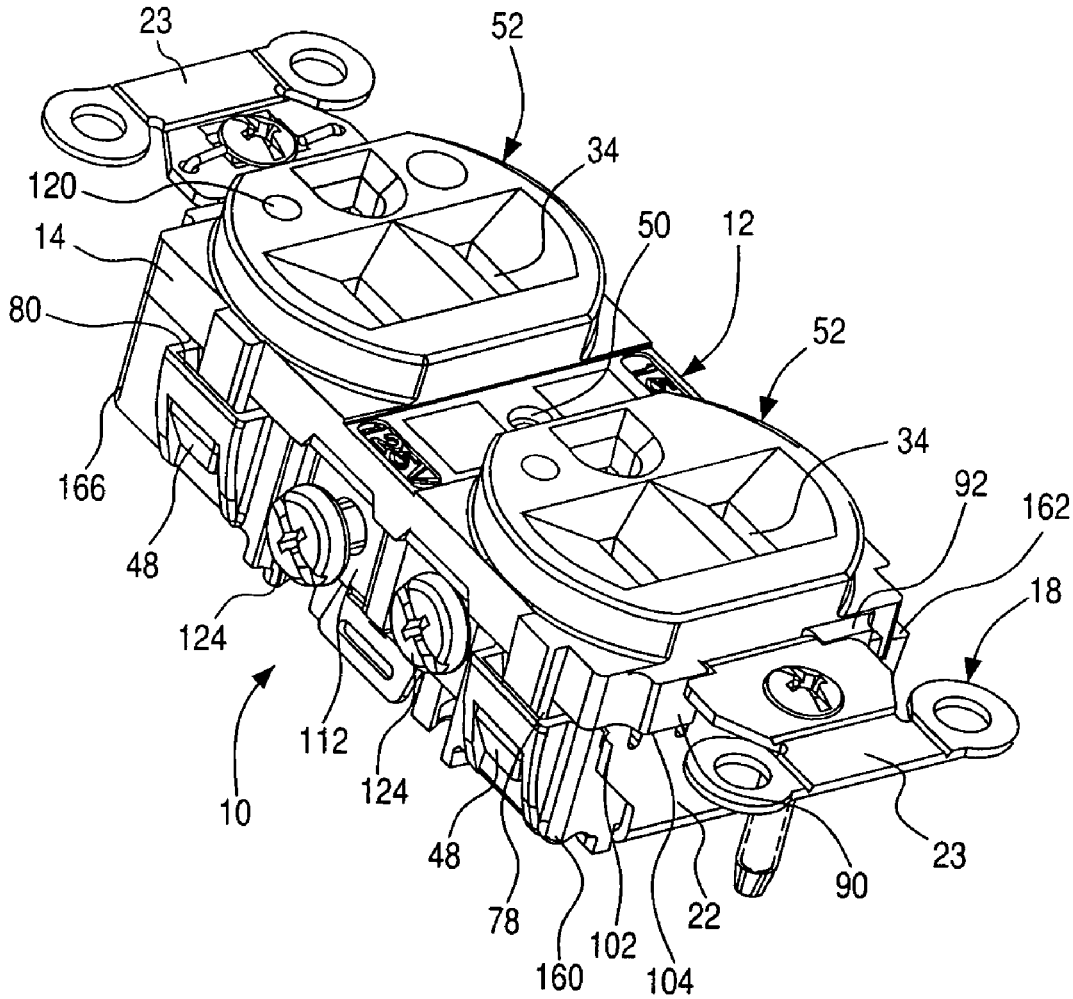
FIG. 2 is a top perspective view of the fully assembled receptacle of FIG. 1.
Figure 3:
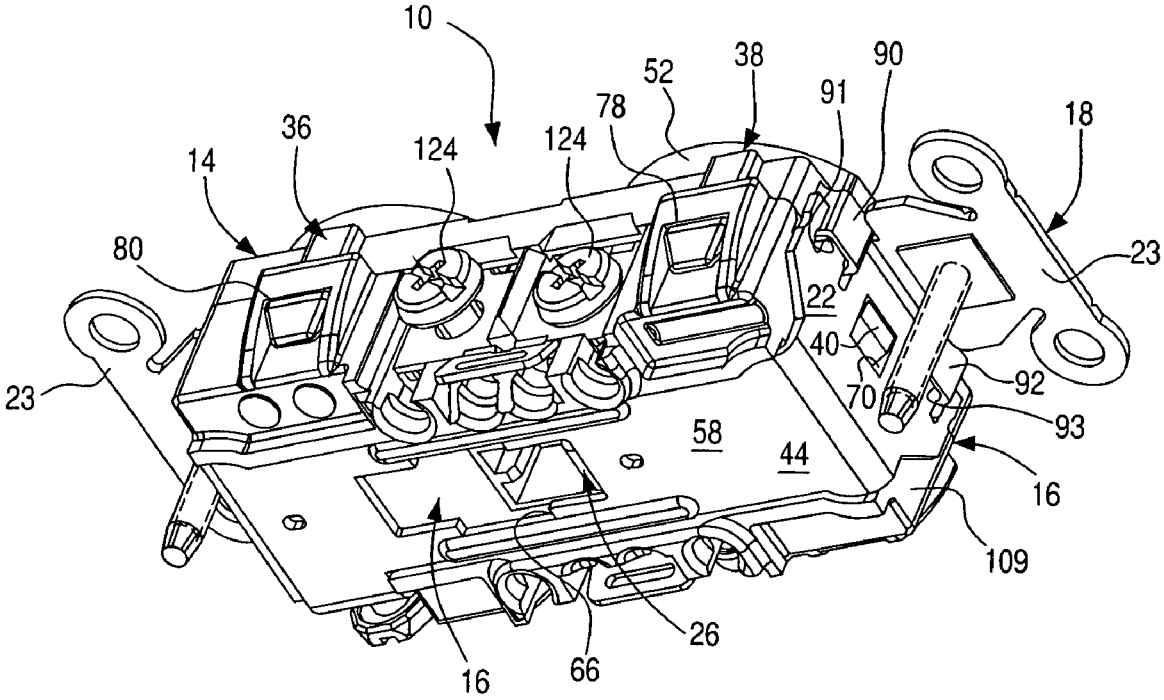
FIG. 3 is a bottom perspective view of the fully assembled receptacle of FIGS. 1 and 2.

As seen in FIGS. 1-3, the receptacle 10 includes a housing 12 made of electrically insulating material having a cover or face member 14 coupled to a base 16. The receptacle also includes a U-shaped mounting bridge 18 with first and second ends 20, 22 connected by a bottom member 58. Mounting ears 23 extend from each end 20, 22. A ramped snap member 40 protrudes from each of the first and second ends 30, 32 of the base 16.

The face member 14 is a standard duplex outlet type having face openings 34 therethrough for receiving two electrical plugs. However, the face member 14 can have any number of outlets and outlet openings for any number or type of electrical devices. The face member 14 can be any of a variety of styles including, but not limited to, flat, finder groove, styleline, tamper resistant, leaded, back wired, and side wired. The upper surface 42 of face member 14 also includes a round hole 50 between the outlet faces 52. Hole 50 is adapted to receive a screw or similar attachment member for securing a wall plate to the receptacle.

Face member 14 and base 16 include means for coupling them together directly. Specifically, first and second posts 36, 38 extend downwardly from the upper surface 42 of the face member 14 and into open-ended base pockets 78, 80. Each post 36, 38 has a body portion 46 extending outwardly from the side of the face member and terminates in a tapered end 48 having a shoulder. Posts 36, 38 slide into base pockets 78, 80 during assembly and snap into place, securing face member 14 and base 16 together directly.

The mounting bridge 18 is preferably a one-piece stamping made of steel or a material of similar strength and flexibility. The first and second ends 20, 22 of the mounting bridge 18 engage the ends 30, 32 of the base 16. As seen in FIG. 3, the mounting bridge 18 also has an aperture 70 at each end sized to receive the ramped snap member 40 on the adjacent end of the base 16. The flat bottom member 58 of mounting bridge 18 extends along a back surface 44 of the base, and has a central opening 66. A center post 26 projects upwardly from the bottom member 58 adjacent the opening 66. The center post 26 is substantially L-shaped with edges 60 perpendicular to the bottom 58 of the mounting bridge 18 as shown in FIG. 1. The post edges 60 carry a plurality of barbs 64. Atop the post 26 is a threaded hole 28 adapted for receiving a screw or similar attachment member for securing a wall plate through hole 50 in face member 14. When the receptacle is assembled, center post 26 tightly fits into slot or pocket 137 in face member 14 (see FIGS. 7 and 8), with barbs 64 solidly gripping the sides of the slot.

Figure 4:
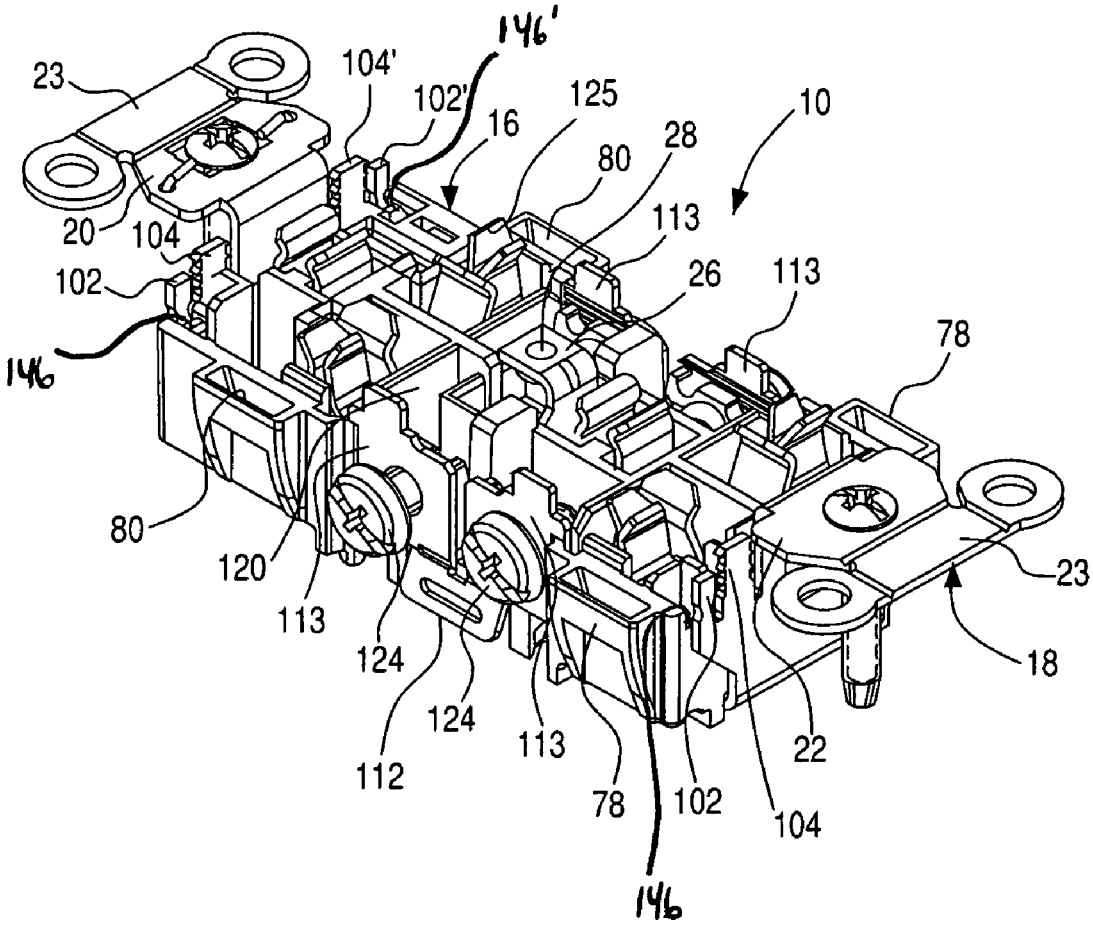
FIG. 4 is a top perspective view of the partially assembled receptacle of FIG. 1 prior to mating with the face member, which is not shown.
Figure 5:
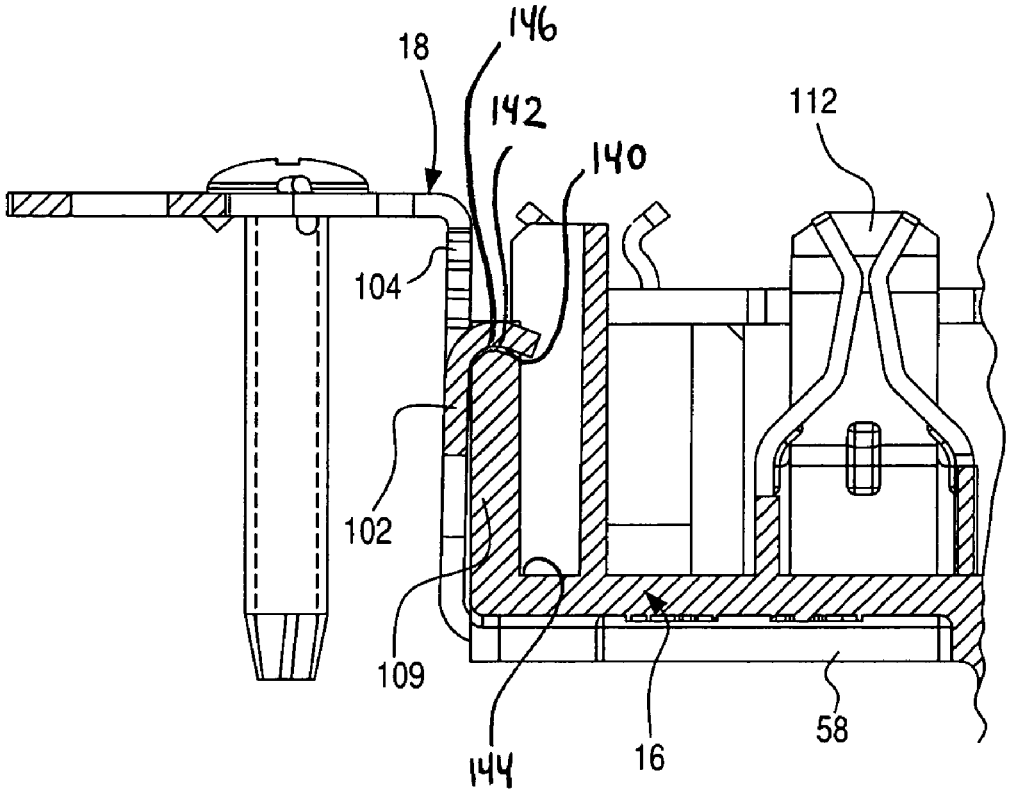
FIG. 5 is a partial longitudinal sectional view of the portion of the receptacle shown in FIG. 6, taken through one end of the receptacle along line 5-5 in FIG. 6.
Figure 6:
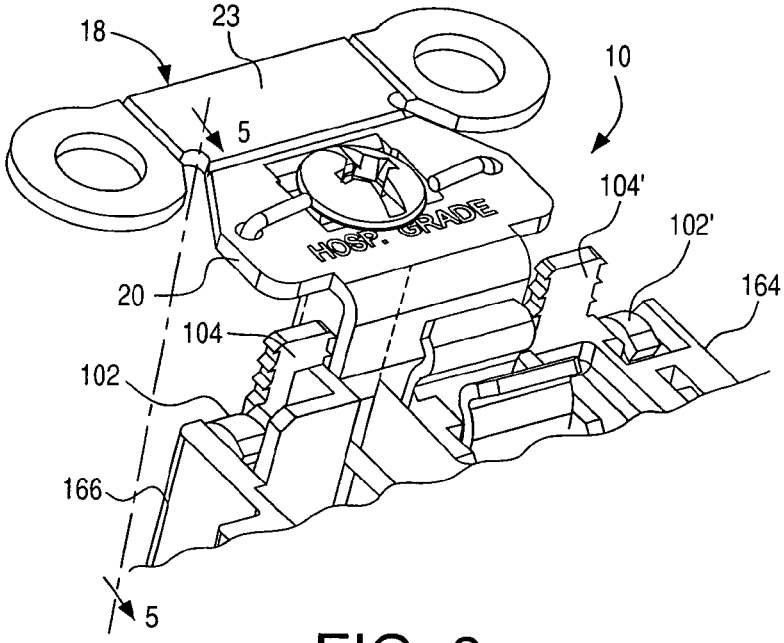
FIG. 6 is a top perspective view of an end portion of the partially assembled receptacle of FIG. 4.

As seen in FIGS. 1 and 4, the mounting bridge 18 further includes a pair of "base" tabs 102, 102' projecting upwardly from each end of the mounting bridge 18 adjacent its edges, and an adjacent pair of "face" tabs 104, 104' that also project upwardly from each end of the mounting bridge. The base tabs 102, 102' are substantially rectangular and are bendable over the upper edge 106 of the base 16. More particularly, as seen in FIGS. 5 and 6, the base tabs can be bent inwardly at least 90° into rectangular recesses in the form of notches 108 along the upper edge 106 of the base 16. When bent over, the base tabs 102, 102' overlie the upper edge 106 of the base 16 near its corners 160, 162, 164, 166, and extend across the entire width of the base wall 109. More specifically, as seen in FIG. 5, base tab 102 has an inner surface 140 adjacent the outer surface 142 of base 16. When base tab 102 is bent inwardly along the base 16, base tab 102 engages the outer surface 142 such that inner surface 140 is substantially parallel with the bottom wall 144 of the base 16. Base tab 102' is similarly constructed. The base tabs thus lock over the wall 109 in notches 108 to secure the base 16 to the mounting bridge 18. With this configuration, each free end edge 146, 146' of the base 16 faces away from the bottom wall 144 with the base 16 being entrapped between the base tabs 102, 102' and the bottom wall 144.

Figure 7:
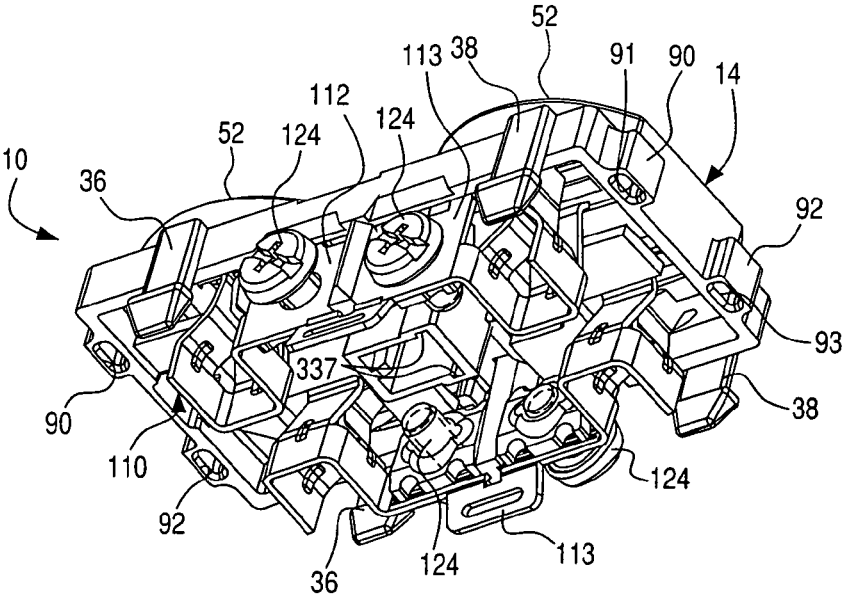
FIG. 7 is a bottom perspective view of the receptacle of FIGS. 1-7 without the base and the mounting bridge.
Figure 8:
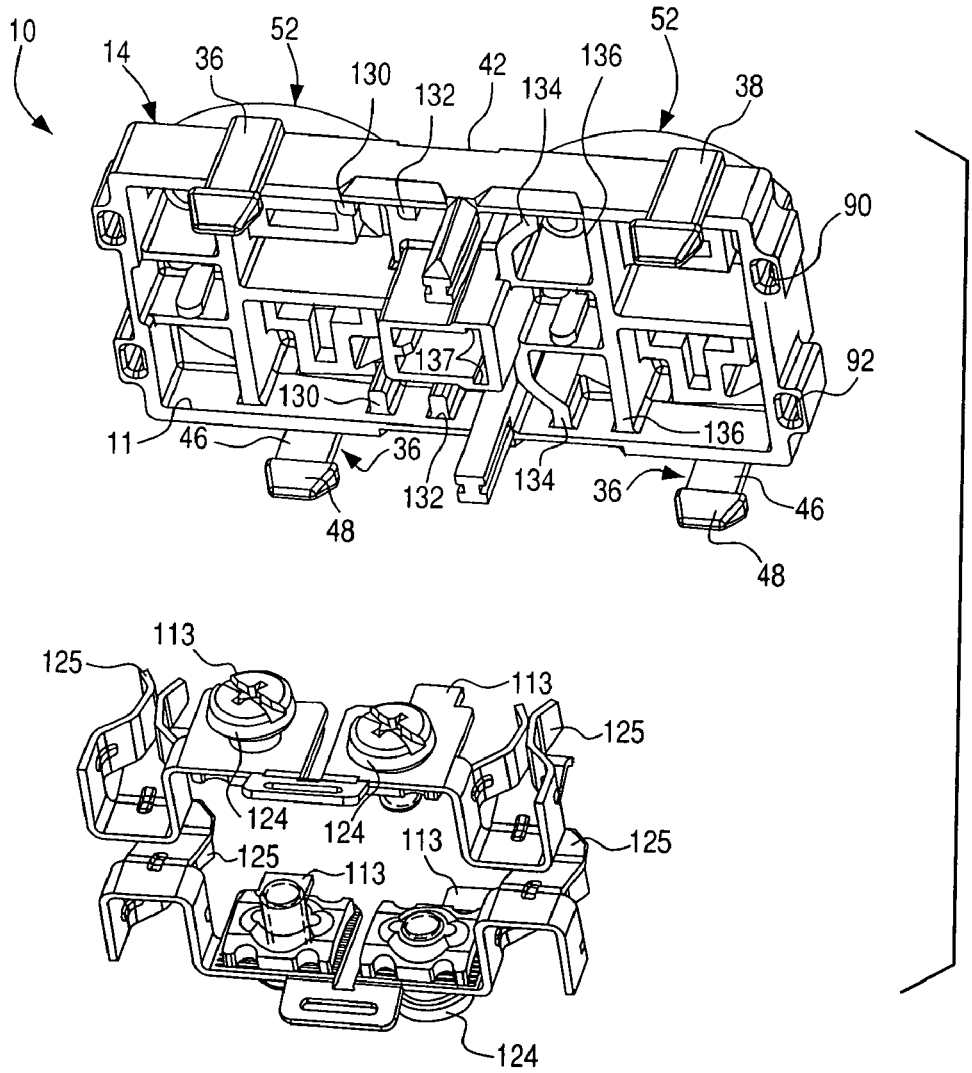
FIG. 8 is an exploded bottom perspective view of the components of the receptacle shown in FIG. 7.

As seen in FIGS. 1 and 6, the face tabs 104, 104' are rectangular and are wider than base tabs 102, 102'. The face tabs 104, 104' have a plurality of barbs 114 along their edges. As seen in FIGS. 3, 7 and 8, blind pockets 90, 92 at each end of face member 14 are aligned with and tightly receive face tabs 104, 104'. The barbs 114 engage the interior surface 91, 93, respectively, of each of the pockets 90, 92 to ensure a secure fit therebetween.

Turning to FIGS. 1, 4 and 8, the receptacle 10 further includes a pair of line contact assemblies (bus bars) 112, 112' for connecting to a source of power through screws 124 and distributing power to the outlets via face contacts 125. The line contact assemblies extend along opposite sides of the base 16 perpendicular to the back surface 44 of the base 16. Each of the line contact assemblies 112, 112' has an upwardly projecting pair of line contact tabs 113 that extend into face member 14. More specifically, each line contact tab 113 is tightly received in a pocket defined by a pair of ribs 130, 132 or 134, 136 disposed along the interior surfaces 11 of the side walls of face member 14.

Assembly of the receptacle components involves first bringing the base 16 into contact with mounting bridge 18. As these components are brought together, the ends 20, 22 of the mounting bridge spread apart and then snap over snap members 40 on the ends of the base, the snap members 40 coming to rest in apertures 70 in the ends 20, 22 (see FIG. 3). Then the base tabs 102, 102' are bent over the upper edge 106 of the base into notches 108, securely joining the mounting bridge to the base. See FIGS. 5 and 6. The line contact assemblies 112, 112' are then installed in respective recesses in base 16. Alternatively, the line contact assemblies can be installed before the base tabs 102, 102' are bent over, or before the base and the mounting bridge are brought together. Final assembly involves bringing the face member 14 into engagement with the subassembly of base 16, mounting bridge 18 and line contact assemblies 112, 112'. As these are pressed together, barbed face tabs 104, 104' penetrate and tightly engage pockets 90, 92 in the face member; barbed center post 26 penetrates and tightly engages slot 137 in the face member; and posts 36, 38 on the face member penetrate and snap into base pockets 78, 80.

As those skilled in the art will appreciate, the receptacle of the invention may also include additional electrical structures or components. For example, FIGS. 1 and 2 depict two light emitting diodes (LEDs) 120 mounted on a printed circuit board 122. For the sake of clarity, these components are not shown in the other figures. While a particular embodiment has been chosen to illustrate the invention, it will be understood by those skilled in the art that various changes and modifications can be made therein without departing from the scope of the invention as defined in the appended claims.

What is claimed is:

1. An electrical receptacle comprising:

a housing having a face member coupled to a base, the face member having surface outlet openings, and the base having a bottom wall, two opposite side walls and two opposite ends walls, said side walls and said end walls coupled to and extending from said bottom wall; and a mounting bridge extending around and contacting the bottom wall and the ends walls of the base, the mounting bridge having first and second end-contacting portions including first and second base tabs, respectively, projecting inwardly into engagement with the respective end wall of the base and extending over a free end edge thereof and having at least one face tab projecting upwardly into the face member, each free end edge facing away from the bottom wall with the base being entrapped between the base tabs and the bottom wall.

2. An electrical receptacle according to claim 1, wherein at least one of said face tabs is wider than at least one of said base tabs.

3. An electrical receptacle according to claim 1, wherein the face tabs are barbed and are tightly received in respective pockets in the face member.

4. An electrical receptacle according to claim 1, wherein the at least one base tab includes an upper section having a first width and a lower section having a second width narrower than the first width.

5. An electrical receptacle according to claim 1, wherein said at least one face tab comprises two face tabs.

6. An electrical receptacle according to claim 5, wherein the face tabs are located inboard and adjacent the base tabs.

7. An electrical receptacle according to claim 6, wherein the face tabs are barbed and are tightly received in respective pockets in the face member.

8. An electrical receptacle according to claim 1, wherein the base tabs are received in respective recesses in the ends of the base.

9. An electrical receptacle according to claim 8, wherein each recess comprises a notch at an upper edge of the base.

10. An electrical receptacle according to claim 1, wherein the base tabs are received in respective notches at an upper edge of the base.

11. An electrical receptacle according to claim 10, further comprising mating snap-fit connectors on the base and the face member.

12. An electrical receptacle according to claim 11, further comprising mating snap-fit connectors on the ends of the base and the end-contacting portions of the mounting bridge.

13. An electrical receptacle according to claim 1, further comprising mating snap-fit connectors on the base and the face member.

14. An electrical receptacle according to claim 13, further comprising mating snap-fit connectors on the ends of the base and the end-contacting portions of the mounting bridge.

15. An electrical receptacle according to claim 1, wherein the base tabs are received in respective notches at an upper edge of the base.

16. An electrical receptacle according to claim 15, wherein the line contact tabs are tightly received in respective pockets in the face member.

17. An electrical receptacle according to claim 1, wherein the first base tab of the first end contacting portion has an inner surface engaging an outer surface of the first free end edge, the inner surface being substantially parallel with the bottom wall.

18. An electrical receptacle according to claim 17, wherein the second base tab of the second end contacting portion has an inner surface engaging an outer surface of the second free end edge, the inner surface being substantially parallel with the bottom wall.

19. An electrical receptacle according to claim 18, wherein the first end contacting portion includes a third base tab having an inner surface engaging an outer surface of the first free end edge, the inner surface being substantially parallel with the bottom wall.

20. An electrical receptacle according to claim 19, wherein the second end contacting portion includes a fourth base tab having an inner surface engaging an outer surface of the second free end edge, the inner surface being substantially parallel with the bottom wall.

21. An electrical receptacle comprising:

a housing having a face member coupled to a base, the face member having surface outlet openings, and the base having a bottom wall, two opposite side walls and two opposite end walls, said side walls and said end walls coupled to and extending from said bottom wall;

a mounting bridge extending around and contacting the bottom wall and the end walls of the base, the mounting bridge having first and second end-contacting portions including first and second base tabs, respectively, projecting inwardly into engagement with the respective end wall of the base and extending over a free end edge thereof, and having at least one face tab projecting upwardly into the face member, each free end edge facing away from the bottom wall with the base being entrapped between the base tabs and the bottom wall; and a pair of line contact assemblies engaging and extending along opposite sides of the base, each of the line contact assemblies having at least one line contact tab that projects upwardly into the face member.

22. An electrical receptacle according to claim 21, wherein at least one base tab includes an upper section having a first width and a lower section having a second width narrower than the first width.

23. An electrical receptacle according to claim 21, wherein said at least one face tab comprises two face tabs, and said at least one line contact tab comprises two line contact tabs.

24. An electrical receptacle according to claim 23, wherein the face tabs are barbed and are tightly received in respective pockets in the face member.

25. An electrical receptacle according to claim 21, further comprising mating snap-fit connectors on the base and the face member.

26. An electrical receptacle according to claim 25, further comprising mating snap-fit connectors on the ends of the base and the end-contacting portions of the mounting bridge.

27. An electrical receptacle according to claim 21, wherein the first base tab of the first end contacting portion has an inner surface engaging an outer surface of the first free end edge, the inner surface being substantially parallel with the bottom wall.

28. An electrical receptacle according to claim 27, wherein the second base tab of the second end contacting portion has an inner surface engaging an outer surface of the second free end edge, the inner surface being substantially parallel with the bottom wall.

29. An electrical receptacle according to claim 28, wherein the first end contacting portion includes a third base tab having an inner surface engaging an outer surface of the first free end edge, the inner surface being substantially parallel with the bottom wall.

30. An electrical receptacle according to claim 29, wherein the second end contacting portion includes a fourth base tab having an inner surface engaging an outer surface of the second free end edge, the inner surface being substantially parallel with the bottom wall.

* * * * *